US006409237B1

(12) United States Patent
Olshausen

(10) Patent No.: US 6,409,237 B1
(45) Date of Patent: Jun. 25, 2002

(54) AUTHORIZED-USER, TAG SEPARABLE, TAMPER-EVIDENT SEAL WITH FIXED-IN-PLACE, REUSABLE CATCHES FOR THIN-WALLED CONTAINERS

(76) Inventor: Michael Cohnitz Olshausen, 1280 21st St. NW. Unit 503, Washington, DC (US) 20036

( * ) Notice: Subject to any disclaimer, the term of this patent is extended or adjusted under 35 U.S.C. 154(b) by 0 days.

(21) Appl. No.: 09/796,655

(22) Filed: Mar. 2, 2001

(51) Int. Cl.[7] ..... B65D 27/30
(52) U.S. Cl. ..... 292/307 A; 292/307 R
(58) Field of Search ..... 292/307 A, 307 R, 292/317–321, 325; 24/573.1; 40/628; 283/105

(56) References Cited

U.S. PATENT DOCUMENTS 4,645,087 A * 2/1987 Kusz ..... 215/254
4,811,844 A * 3/1989 Moulding, Jr. et al. ..... 206/459
5,765,885 A * 6/1998 Netto ..... 292/318
6,109,673 A * 8/2000 Olshausen ..... 292/307 A

* cited by examiner

*Primary Examiner*—Teri Pham Luu

(57) ABSTRACT

A tamper-evident seal adapted to be attached to a variety of thin-walled containers, including cabinets having glass doors (700), lockers, file cabinets, and the like. Plug-like catches (300) that may be anchored individually in an aperture in a thin wall are connected by a seal element (100) bearing an identification tag (110). Removal of the tag immediately separates the seal element into two parts, each of which can pass entirely through the plug-catch to which it has been connected, freeing the catch to accept another seal. The tag may continue to be used after its removal to serve a commercial purpose, such as offering to a guest who has made use of the sterilized lockers in a resort hotel's weight room a premium for redeeming the tag, thus to create an opportunity to sell the guest a service, perhaps dance or scuba lessons.

17 Claims, 8 Drawing Sheets

Fig. 17
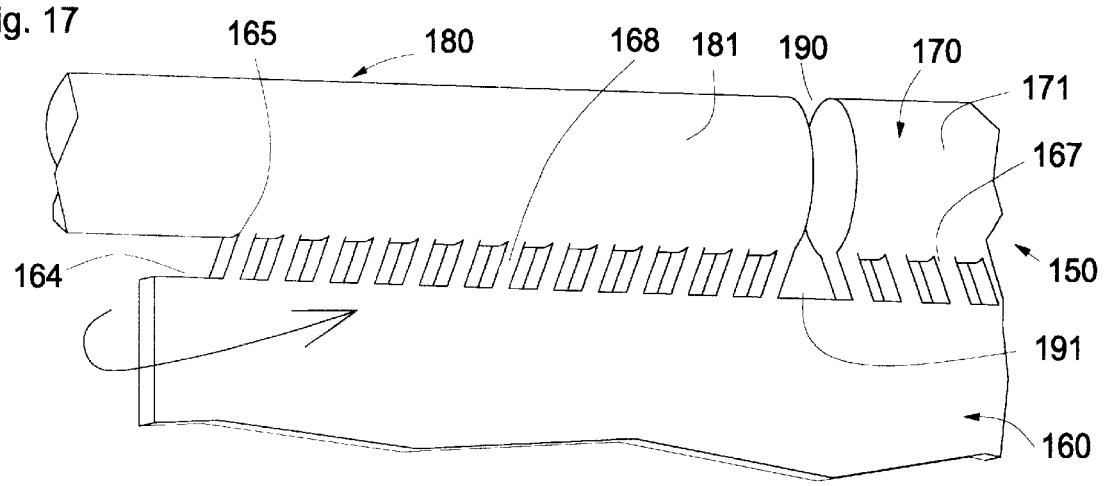
Fig. 18
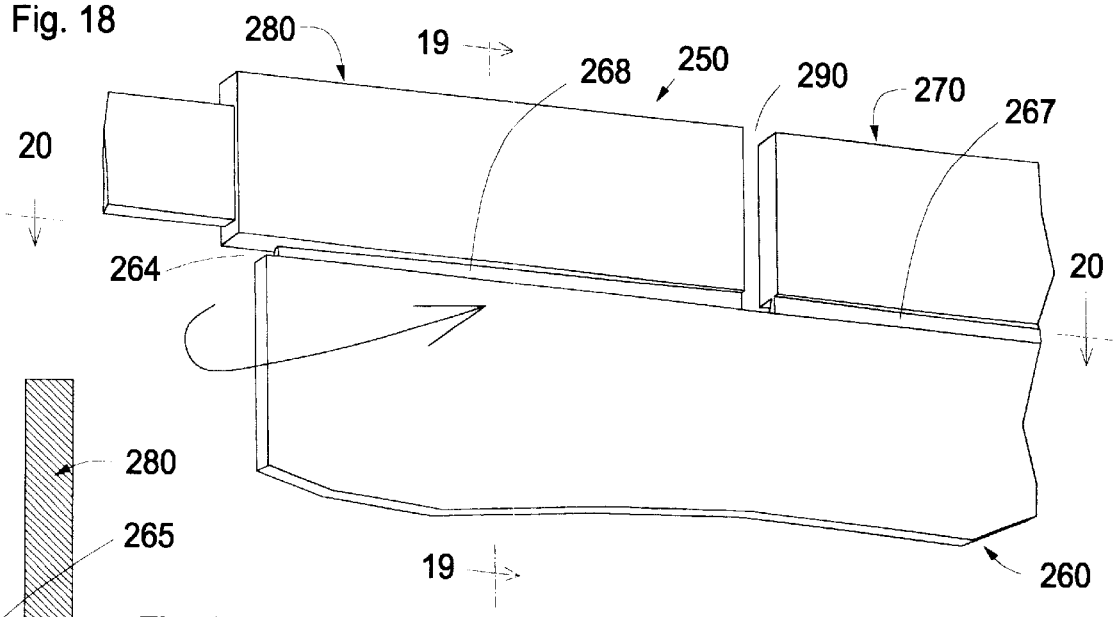
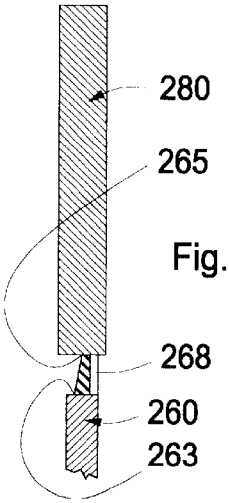
Fig. 19
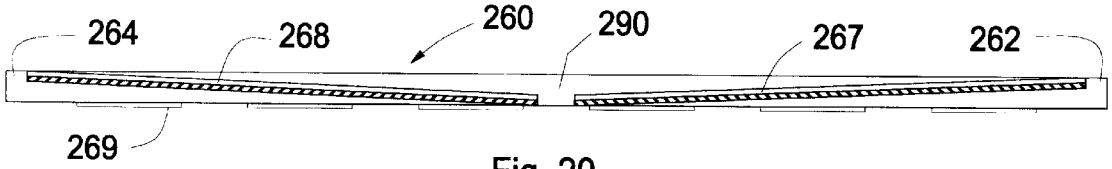
Fig. 20

AUTHORIZED-USER, TAG SEPARABLE, TAMPER-EVIDENT SEAL WITH FIXED-IN-PLACE, REUSABLE CATCHES FOR THIN-WALLED CONTAINERS

CROSS-REFERENCE TO RELATED APPLICATIONS

U.S. patent application Ser. No. 09/369,350.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention relates to tamper-evident seals, in particular to U.S. Pat. No. 6,109,673 to Olshausen (2000) and to U.S. patent application Ser. No. 09/602,337, filed as a continuation in part to U.S. Pat. No. 6,109,673 on Jun. 24, 2000 which issued as U.S. Pat. No. 6,371,539. However, the present application is not a continuation in part of either one of those prior filings.

Tamper-evident seals attach to most objects usually with a bit of difficulty and often rather unaesthetically. Typically, a pair of apertures must be provided, one on each of two movable parts of the object, through which a seal can be passed. Eye-bolts sometimes are welded onto the parts, or, as shown in U.S. Pat. No. 2,401,965 to Rossiter (1946) the parts may come manufactured with built-in apertures. Often, as with Rossiter's part 15, some element of the seal-related mechanism will stick out maybe an inch or two from the adjacent, flat surfaces, just enough to rip a shirt on when the door to the sealable compartment is left open. A great many, thin-walled objects, such as the glass of a cabinet or the sheet-metal of a locker, are not particularly suited to the support of protruding elements, which, should they get whacked, and everything does get whacked eventually, can exert on the thin-walled material a strong-enough, sudden stress or torque to bend or shatter it. Locker handles typically do have apertures for the hasp of a lock, but, if a lock is already in use, not much room remains for the additional insertion of a tamper-evident seal.

Neither U.S. Pat. No. 6,109,673 nor U.S. Pat. No. 6,371,539 specifically addresses the thin-wall problem. Basically each requires some ancillary object, a chain link, a staple, which in turn must be screwed or glued or riveted or welded or somehow otherwise battened onto an object, in order to be attached.

And then there is also the motive thing. Most tamper-evident seals, including those of U.S. Pat. No. 6,109,673 and U.S. Pat. No. 6,371,539, basically are intended to keep people from indulging their, perhaps we should say, momentary baser instincts to pry or pilfer. The use of such seals does not arise from a sanguine view of humanity. A less adversarial point of departure is arguably represented by the tamper-evident, container seal in U.S. Pat. No. 4,645,087 to Kusz (1987). In Kusz, the stranger of the greatest importance is not the miscreant but rather the customer, the authorized user, authorized usually in virtue of a purchase. Deterrence, to be sure, remains important but with the understanding that the relatively few, serious attempts to do damage will likely weigh less before the bar of public opinion than a product's quality and its manufacturer's due diligence in protecting that quality. To the customer the seal says we've thought of you, this is a fresh product, you can take this.

There are, it's true, times and circumstances in which a message needs to be sent, but in which, nevertheless, a light touch is desirable. Maybe Ann has forgotten to pay her dues for a time at a swim club, but she still uses it. The stock market's been bad and so on, money's been tight. The swim club wants to keep her as a member very much, but it also needs to have its dues paid. So, it attaches an easily-broken, tamper-evident seal to her locker. She can still stow her stuff and use the pool, but now she has been tactfully, although clearly, reminded of an arrear and of fraying patience.

The present invention aims to serve and to preserve these more user-friendly, customer-first sort of options. In particular, it provides an easily-severable, tamper-evident seal having dual, independent catches, each adapted for easy attachment to a thin walled-container. It provides, in addition, a structurally essential, tear-off ID tag, which may be used, for example, to redeem a premium, such as a room-discount at a hotel.

BRIEF SUMMARY OF THE INVENTION

In U.S. Pat. No. 6,109,673 and U.S. patent application Ser. No. 6.371,539, both op. cit., as well as in U.S. Pat. No. 5,765,885 to Netto (1998), perforations attach an ID tag to the main body of a seal. For all of these devices, however, mere removal of the ID tag does not render the device unusable. Tag removal in U.S. Pat. No. 6,109,673 is necessary to allow the seal element to pass through and out of either catch element. But, if a seal element that already had had its tag removed were to be found, say in a bag of 100, it could still be used as a seal. In none of these reference does the tag function to guarantee the structural integrity of the seal.

The present invention makes the tag a guarantor of seal integrity by splitting the seal, apart from the tag, into two, generally symmetric, "halves" joined only by the tag and contiguous separation means. If the tag is fully removed, either end of the seal may now be passed through the catch with which it has been in locking engagement without the need to sever from the seal either of the seal's studs, or, as the case may be, the seal's linear ratchets, by force. The tag need not even be fully removed to open the seal-protected container. It's enough just to free up one of the seals "halves".

The present invention furthermore takes the concept of dual, independent catches found U.S. Pat. No. 6,109,673 and in U.S. Pat. No. 6,371,539 and reinvents it for use in a thin-walled setting. The result is a variety of plug-like objects, each bearing a catch and each specifically adapted either to self-anchor into an aperture or to be mechanically anchored from behind an aperture. Inasmuch as the apertures will often have front surfaces lying in substantially the same plane, the catches will often face in the same direction, so that the seal has to be bendable.

A means is presented for optimizing perforation design by concentrating tear-off force at an acutely angled junction of a given perforation tooth with the tooth's adjacent half-midsection of the seal. An alternative separation means is presented, not involving perforation teeth, that simultaneously reinforces the integrity of the tag-to-seal-half-midsection link while also making easy tearing off the ID-tag. This alternative separation means is among the simplest for which to build a mold, and thus marginally reduces mold costs.

With the foregoing in mind, it is an important object of the present invention to provide a tamper-evident seal for thin-walled containers that is both easily attached and easily removed with a minimum of force.

It is yet another object of the present invention to provide for easy replacement and/or repair of the seal's catch elements.

It is yet another object of the present invention to provide for easy bending of the seal element in order to engage catch elements both facing in the same direction.

It is still a further object of the present invention to be adaptable to a variety of wall thicknesses and orientations.

It is still a further object of the present invention to provide a tag that may be easily removed and used to serve some commercial purpose.

These and yet further objects and advantages of the present invention will become apparent from a consideration of the following, detailed specification, drawings, and appended claims.

BRIEF DESCRIPTION OF THE SEVERAL VIEWS OF THE DRAWING

Referring to the drawings, wherein like reference characters indicate like parts or elements throughout the several views, and in which solid arrowheads point to compound objects whose numbered resolution into constituent parts occurs when it is germane to the discussion:

FIG. 17 is a fractional, greatly enlarged, front perspective view of a forth embodiment of the seal element of the present invention, emphasizing a salient point thereof.

FIG. 18 is a fractional, greatly enlarged, front perspective view of a fifth embodiment of the seal element of the present invention, emphasizing a salient point thereof.

FIG. 19 is a cross-sectional view of FIG. 18 taken along lines 19—19 and enlarged in scale.

FIG. 20 is a cross-sectional view of the seal embodiment represented by FIG. 18 taken along lines 20—20 and on the scale of FIG. 19.

DETAILED DESCRIPTION OF THE INVENTION

Figure 1:
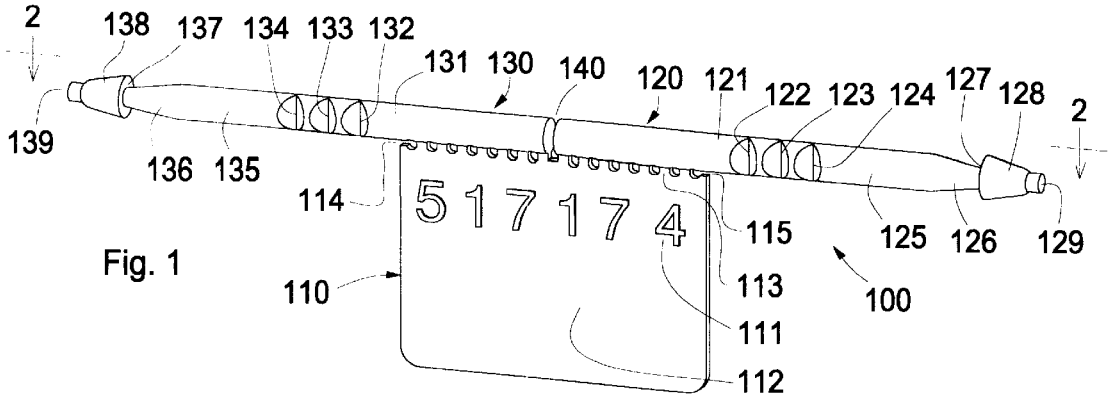
FIG. 1 is a front perspective view of a first embodiment of the seal element of the present invention.

FIG. 1 shows seal element 100 having ID-tag 110. Left half-midsection 130, or simply left arm 130, has medial cylindrical segment 131 and distal cylindrical segment 135, both sharing the same axis and radius. Joining 131 to 135 is a coaxial, like-radiused segment of 130 that, however, has three, substantially coplanar, parallel, thin sections 132, 133, and 134, each formed by a pair of oppositely-placed, 60°, wedge-shaped cut-outs. At the distal end of 130 and smoothly joining 135 is tapered segment 136. Abutting segment 136 at flat face 137 is rounded stud 138 having short, calendrical, end stub 139. Stud 138 is rotationally symmetric, sharing the axis of symmetry of members 131 and 135. The largest radius, however, of stud 138 is greater than the radius of the remainder of 130, for the sake of illustration being 20% larger in FIG. 1. The radius of stub 139 is substantially smaller than the radius of 131.

Right half-midsection 120, a.k.a. right arm 120, has medial cylindrical segment 121 and distal cylindrical segment 125, both sharing the same axis and radius, these being the same as the axis and radius of 131. Joining 121 to 125 is a coaxial, like-radiused segment of 120 that, however, has three, substantially coplanar, parallel, thin sections 122, 123, and 124, each formed by a pair of oppositely-placed, 60°, wedge-shaped cut-outs. At the distal end of 120 and smoothly joining 125 is tapered segment 126, identical in form and dimensions to segment 136. Abutting section 126 at flat face 127 is rounded stud 128, identical in form and dimensions to stud 138 and having short calendrical end stub 129 identical to 139. Stud 128 shares the axis of symmetry of members 121 and 125.

Most importantly, gap 140 separates arm 120 from arm 130, which thus are connected only to ID-tag 110 and not directly to each other. Furthermore, the connection to tag 110 is by a separation means, here perforation teeth 113, of which seven are shown on each side of 100. Perforation teeth 113 are shown to be as thick as tag 10 itself, in practice about 0.04". They are thus somewhat thicker than the perforation teeth shown in FIG. 8 of U.S. Pat. No. 6,109,673. This is because teeth 113 serve a structural purpose, that of maintaining the integrity of seal element 100 as a whole during unstressed use and normal storage. In U.S. Pat. No. 6,109,673 the perforation teeth needed merely to hold the tag onto the seal's midsection, a task requiring somewhat less strength.

Seal-element embodiment 100 has one plane of symmetry, namely the medial plane passing centrally though gap 140 perpendicularly to tag 110.

At the ends of tag 110 are gaps 114 and 115 which not only make tearing-off tag 110 easier, but which also serve as visual cues to an unfamiliar user that tag 110 can be torn off, perforations generally being interpreted to mean that a thing is tear-offable.

ID-tag 110 also carries identifier 111, here an integrally formed, as by molding, raised serial number. The serial number might also be hot-stamped on, though there is a distinct advantage to using a raised identifier: it provides a convenient gripping aid for fingers wanting to tear off tag 110. Below 111 is blank space 112, which may be variously used, as to write or imprint a message on, or for a company logo, etc.

Figure 2:
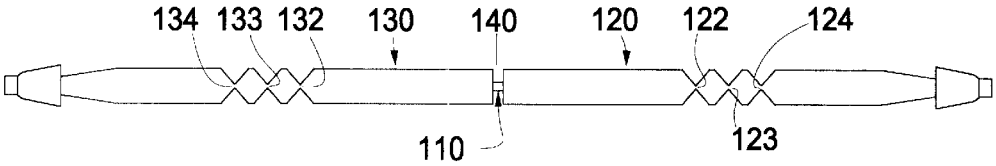
FIG. 2 is a top plan view of the embodiment shown in FIG. 1 taken along lines 2—2.

FIG. 2 shows gap 140 between seal arms 130 and 120 more clearly. Thin sections 122, 123, 124, and 132, 133, 134 function essentially as hinges. The polypropylenes, from which many tamper-evident seals are molded, are well known as a "'living hinge' thermoplastic[s]" (see *Plastics Engineering Handbook of the Society of the Plastics Industry, Inc*, by Michael L. Berns, Van Nostrand Reinhold, 1991, p.54). Controlling the degree to which a plastic resin is "filled", sometimes with glass, or carbon, or other fibers, is a means for closely controlling its brittleness. In the present case, there is a bias toward flexibility, so that the seal's thin-section hinges do not break easily when stressed. Unlike the usual tamper-evident seal, which breaks most readily at the junctions of its studs (or linear ratchets) with its remaining elements, here, there actually is a benefit to keeping the seal flexible enough so that the little perforation teeth each, individually, become the weakest points of the structure, though they remain stronger in sum on either side of 100 than that side's junction of its stud with its half-midsection or than its hinge sections. The authorized user and, of course, the miscreant will likely see at once that the best way to open the seal is simply by tearing off ID-tag 110.

Figure 3:
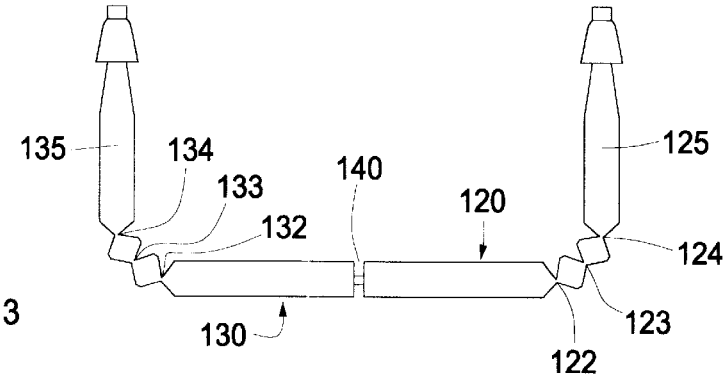
FIG. 3 is a top plan view of the embodiment shown in FIG. 1 after being bent at each end.

FIG. 3 shows element 100 after arms 120 and 130 have been bent at right angles, as their "hinges" anticipate they will be. Note that with three, 60°, wedge-shaped cutouts to work with, a 90° turn demands relatively modest material elasticity.

Figure 4:
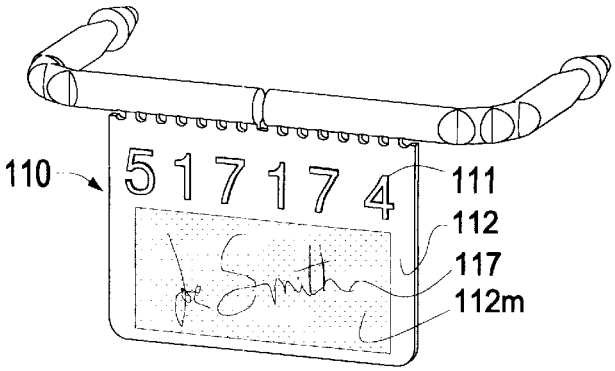
FIG. 4 is a front perspective view of the embodiment shown in FIG. 1 and bent as in FIG. 3.

FIG. 4 shows a version of tag 110 in which area 112*m* of blank space 112 has been given a matte finish to create a writing surface. One Joe Smith, evidently, has signed the tag.

Figure 5:
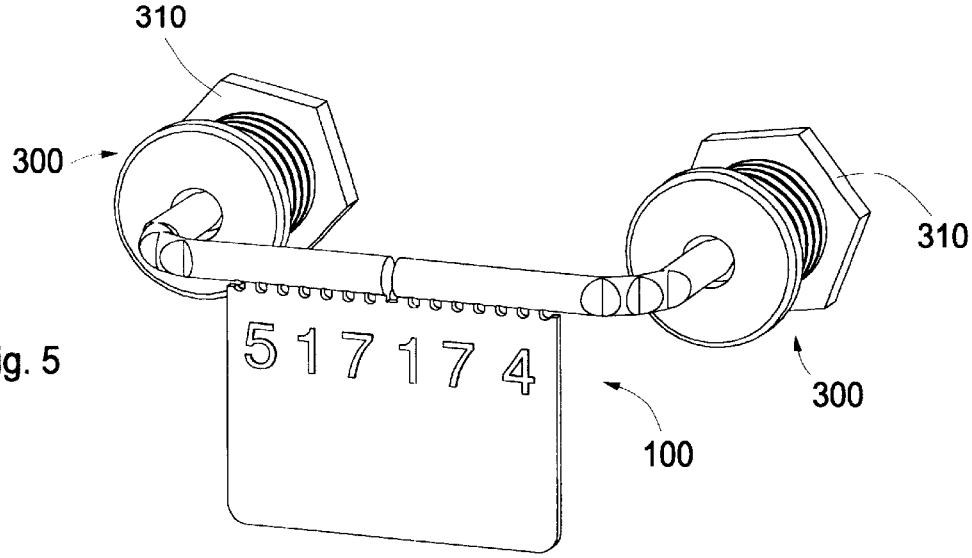
FIG. 5 is a front perspective view of the first embodiment of the present invention in its entirety.

FIG. 5 shows seal element 100 in locking engagement with two, identical plug-type catches 300, each threaded to receive identical nut 310. These elements are described in detail below.

Figure 6:
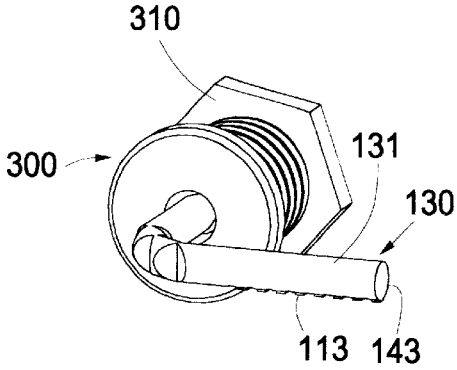
FIG. 6 is a front perspective view of a remainder of the embodiment shown in FIG. 5 after portions of it have been severed and removed.

FIG. 6 shows the remainder of seal 100 after tag 110 has been torn off and arm 120 has been removed along with the tag. All that's left is arm 130, with remnants of perforation teeth 113 still attached to section 131. Flat end 143 of arm 130 was once the left face of gap 140.

Figure 7:
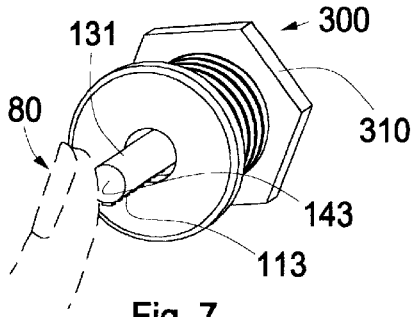
FIG. 7 shows the same elements as in FIG. 6 but after the movement of one of these elements part of the way through the other.

FIG. 7 shows segment 131 about to be pushed into and possibly through plug-catch 300. In an arbitrary, thin walled container, where it may not be practical or possible to see the rear of plug-catch 300, finger 80 pushing on end 143 may leave the last few millimeters of segment 131 in catch 300. Or, segment 131 may indeed fall out and plop down into the space between, say, sheet metal walls, as perhaps of a file cabinet. Should segment 131 stick in 300, that's okay, however, because segment 131 is smaller in diameter than the greatest diameter of stud 138 and so will not strain the resilient, relatively tougher material, possibly a nylon or a polycarbonate, from which plug-catch 300 is made. The reason for end stubs 139 and 129 now becomes clear. When a replacement seal is installed, cylindrical end stubs 139 and 129 help the user to push any leftover portion of a previous seal out of catch 300. By contrast, rounded ends or tapered, leader-like ends, common among seal designs, would be unhelpful in removing such leftovers.

Figure 8:
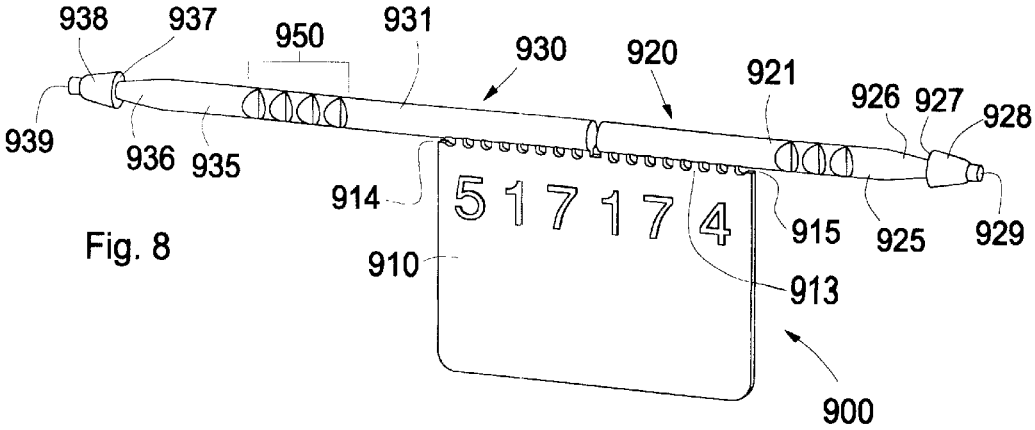
FIG. 8 is a front perspective view of a second embodiment of the seal element of the present invention

FIG. 8 shows second, non-symmetric embodiment 900 of the present invention's seal element. Arms 920 and 930 are unequal in length, as are also their corresponding components 921 and 931, and 925 and 935. Components 926, 936, 927, 937, 928, 938, 929, and 939 are identical to their analogously number components of seal element 100. We note that, unlike arm 130, arm 930 has a group 950 of four, rather the three, "hinge" sections, as a group analogous to 132, 133, and 134, each "hinge" being formed by a pair of oppositely-placed, 60°, wedge-shaped cut-outs. With four "hinges" on arm 930, seal embodiment 900 more easily wraps around a corner. Note that seal 900 has eight perforation teeth 913 on each side, one more than seal 100. Gaps 915 and 914 are negligibly shorter than, but fulfil the same purpose as, gaps 113 and 114.

Figure 9:
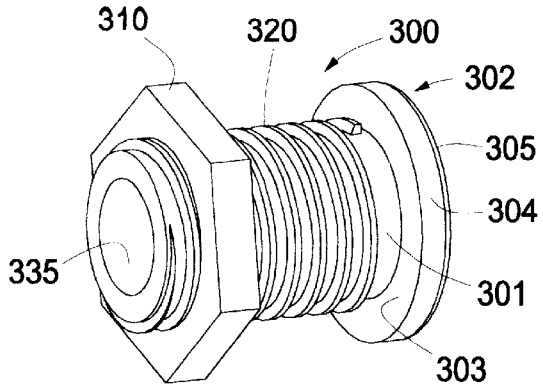
FIG. 9 is a side perspective view of the embodiment of the catch elements shown in FIG. 5 but on a larger scale.

FIG. 9 shows a first embodiment 300 of the plug-type catch of the present invention, having cylindrical body 301 and cylindrical flange 302. Flange 302 has flat, rear surface 303, rim 304, and filleted front edge 305. About body 301 and integrally formed with it are threads 320, which mate with hex nut 310. Plug catch 300 is open at both ends, with cylindrical, inner surface 335 here showing.

Figure 10:
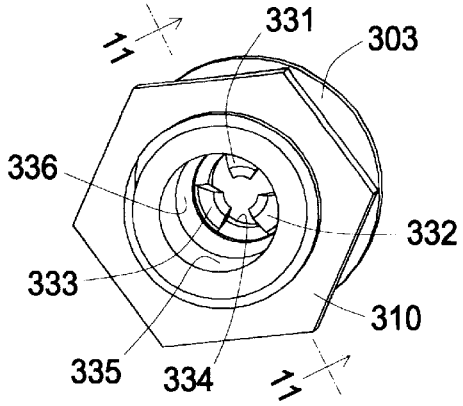
FIG. 10 is a rear perspective view of the element shown in FIG. 9.

FIG. 10 shows three, symmetrically placed, resilient fingers 331, 332, and 333, which together move apart as seal element 100 is forced through them, then spring back to lockably engage stud 138, alternatively stud 128, such that the engaged stud may not be withdrawn without breaking off from its respective tapered element, 136 or 126, in the usual manner. The interior of plug catch 300 is formed, apart from these resilient fingers and their adjacent, interrupted surfaces, by cylindrical surfaces 334, 335, and 336.

Figure 11:
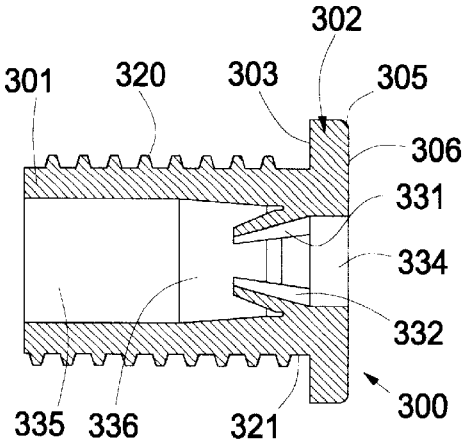
FIG. 11 is a cross-sectional view of the element shown in FIG. 10 taken along lines 11—11.

FIG. 11 shows threads 320 in cross-section, in particular showing that thread root 321 can be made the closest approach of threads 320 to rear surface 303 of flange 302. Such a design is useful for attaching plug 300 to a thin-walled container having a wall thick-ness only slightly less than thread root 321.

Figure 12:
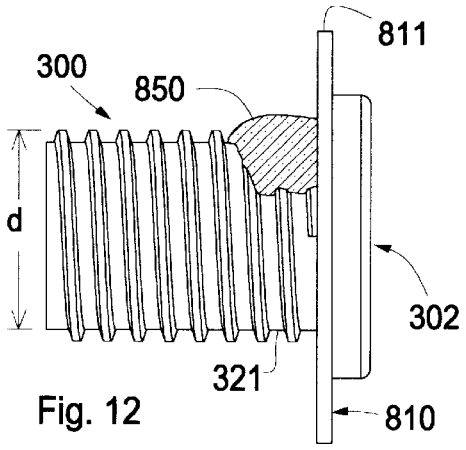
FIG. 12 is a side view of one of the elements shown in FIGS. 9 and 10 after its attachment to a generic, thin wall by a deformable, hardenable substance.

Such an arrangement is shown in FIG. 12. Wall 810 has wall thickness 811 slightly less than thread root 321. When plug-catch 300 is turned in a round aperture formed in wall 810, provided that the aperture's diameter is very sightly greater than distance d in the figure, plug catch 300 will be drawn into the aperture until flange 302 is brought up snug against wall 810. Plug catch 300 may then be secured by nut 310, or else by blob 850 of epoxy putty pressed into and around the junction of plug-catch 300 and wall 810, as shown, and allowed to harden.

Figure 13:
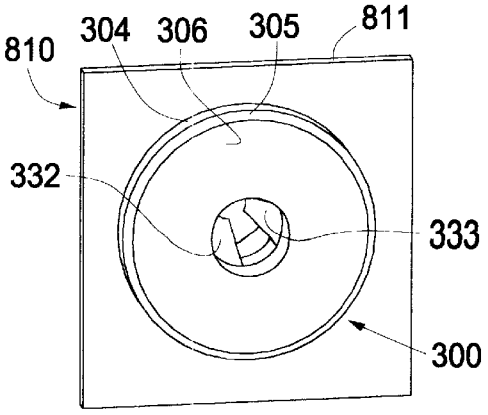
FIG. 13 is a front perspective view of the elements shown in FIG. 12.

FIG. 13 shows plug-catch 300 as it would appear from an end-user's perspective following its secure attachment to generic, thin wall 810.

Figure 14:
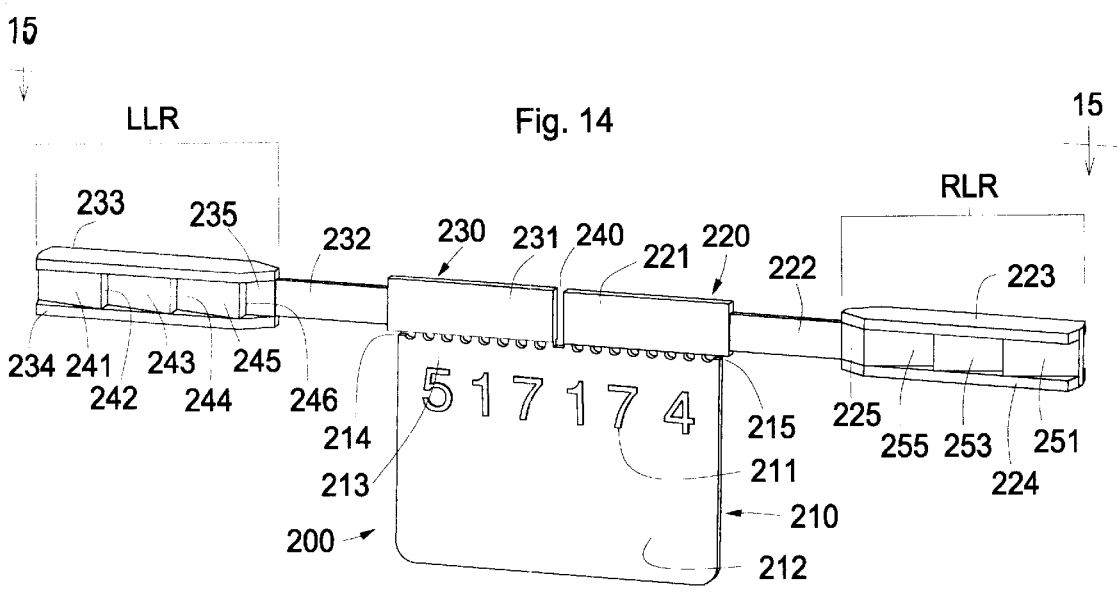
FIG. 14 is a front perspective view of a third embodiment of the seal element of the present invention on the scale of FIG. 1.

FIG. 14 shows third embodiment 200 of the seal element of the present invention, having flat rather than rounded constituent elements to simplify mold making, and having at its extremities short, right and left linear ratchets, RLR and LLR, respectively, instead of single studs. Each linear ratchet will lockably engage a suitably formed plug-catch, of which several forms are described in detail below. Right and left arms 220 and 230 have half-midsections 221 and 231 and least-cross-sectional portions 222 and 232, respectively. Although shown to be equal in length, portions 222 and 232 might also be unequal, as are arms 920 and 930 of seal embodiment 900. Portions 222 and 232 here assume the hinge function of the thin-section hinges of seal embodiments 100 and 900, and so allow embodiment 200 to be bent. Right and left linear ratchet RLR and LLR have top and bottom plates 223 and 224, and 233 and 234, respectively, between which are triangular elements 251, 253, and 255, and 241, 243, and 245, respectively. Flat faces 242, 244, and 246 of the triangular elements of LLR each function analogously to flat surface 137 of stud 138. RLR has faces 252, 254, and 256 (see FIG. 15) each of which functions analogously to surface 127 of stud 128. Tag 210 is identical to tag 110, having identifier 211, blank space 212, separation means 213, again perforation teeth, seven for each side of 200, and starter gaps 214 and 215. RLR attaches through its element 225 to portion 222 of 220, and LLR attaches through its element 235 to portion 232 of 230. Elements 225 and 235 are not greater in cross-sectional area than any other member of their respective, dimensionally identical linear ratchets. Thus arm 220 will break preferentially either at the junction of 222 and 225 or at the junction of 222 and 221, where arm 220 is understood to include RLR itself. Likewise, arm 230 will break preferentially either at the junction of 232 and 235 or at the junction of 232 with 231, where arm 230 is understood to include LLR itself.

Most importantly, gap 240 separates arms 220 and 230, which are thus connected only to ID-tag 200 and not directly to each other. Furthermore, the connection to tag 210 is by a separation means, here perforation teeth 213. Note that, although the upper surfaces of midsections 221 and 231 are respectively coplanar with the upper surfaces of plates 223 and 233 and with each other, the bottom surfaces of midsections 221 and 231 lie somewhat above the coplanar bottom surfaces of plates 224 and 234. This allows perforation teeth 213, after being severed, to pass more easily into and through the plug catches.

Figure 15:
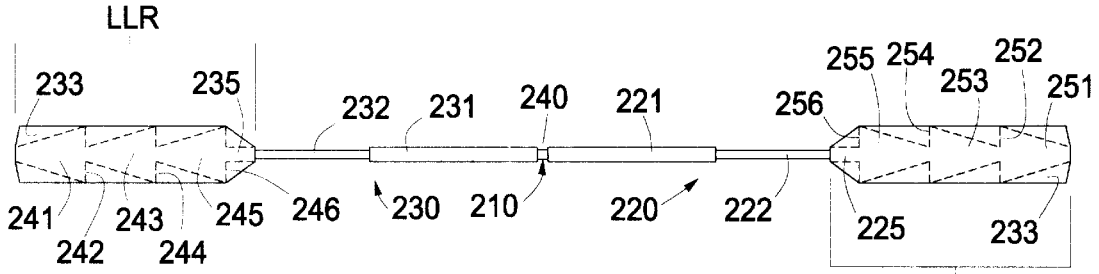
FIG. 15 is a top plan view of the embodiment shown in FIG. 14 and taken along lines 15—15.

FIG. 15 shows more clearly the cross-sectional relationships just described. In their aggregate on either side of seal 200, perforation teeth 213 are stronger than the junction of 222 with either 225 or 221, or of the junction of 232 with either 235 or 231, but are much weaker individually.

FIG. 15 also emphasizes that the ends of RLR and LLR are blunt in order serve the same dislodging purpose as the stubs 129 and 139 of seal element 100.

Figure 16:
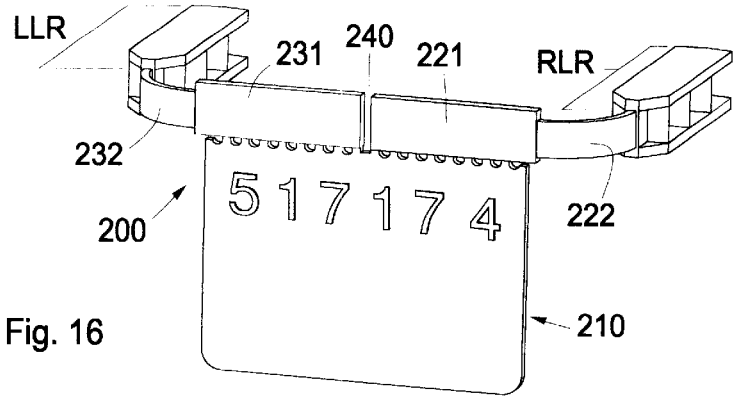
FIG. 16 is a front perspective view of the embodiment shown in FIG. 14, but bent in the same manner as the first seal embodiment shown in FIG. 4.

FIG. 16 emphasizes the flexibility of least cross-sectional elements 222 and 232, which permit respective arms 220 and 230 to be bent, here at right angles. This allows seal element 200 to be used with catches whose front surfaces are, for example, in substantially parallel alignment.

FIG. 17 shows an alternative form for the perforation teeth used to connect the tag of the present invention to the remainder thereof, and, at the same time, to maintain the structural integrity the whole. Now the teeth that join the seal-element's two, otherwise-unconnected half-midsections are oppositely slanted.

In FIG. 17, fourth seal-element embodiment 150, identical in all respects except its perforation teeth to embodiment 100, has arms 170 and 180, which in turn have half-midsections 171 and 181, respectively, separated by gap 190. The separation means of seal embodiment 150 comprises slanted perforation teeth 167, connecting tag 160 to seal half-midsection 170, and oppositely slanted (i.e. slanted oppositely with respect to seal element 150's medial plane) perforation teeth 168, connecting tag 160 to seal half-midsection 180. The opposite slanting of teeth 167 and 168 gives rise to gap 191 at the top of tag 160 that is wider than gap 190.

Teeth 168 slant away from gap 164 at the left end of tag 160, here the end nearest to arm 180, meeting seal half-midsection 181 in arced, acutely-angled, junctions 165. The acute angle at the junctions 165 compared to the oblique angle formed by each tooth 168 where it meets tag 160 nearest to gap 164, concentrates any force tending to tear off tag 160, usually a twisting force as represented here by the large, right-and-upward-sweeping arrow, at the top of the perforation teeth, thus preferentially severing them nearer to half-midsection 181 than to tag 160. This design seeks to minimize the amount of residual material left behind on half-midsection 181 after tag removal, in order to smooth the passage of 181 into and through plug-like catches 300. Similarly for half-midsection 171. The opposite slanting of teeth 167 and 168 furthermore increases the structural stability of seal element 150 as a whole over the stability of seal element 100 as a whole.

FIG. 18 shows fifth embodiment 250 of the seal element of the present invention, identical in all respects to seal element 200 except for the separation means used to connect tag 260 to arms 270 and 280. Here, perforations are not used, rather the separation means comprises two abscission strips, 267 and 268, connected respectively to arms 270 and 280. Gap 290 separates arms 270 and 280, and strips 267 and 268. At the distal end of strip 268 is gap 264, which serves both to facilitate tearing in the direction shown by the large, right-and-upward-sweeping arrow and as a visual cue that tearing-off is possible.

FIG. 19 shows that strip 268 is narrower where it meets arm 280 than where it meets tag 260, so that the junction line 265 is acutely angled. Strip 268's cross-section is small compared to the cross-section either of tag 260 or arm 280. Thus strip 268 will sever preferentially nearer to arm 280 than to tag 260 when a twisting force is applied.

FIG. 20 shows tag 260 in its entirety from above after separation from seal element 250. Gap 262 serves strip 267 as gap 264 serves strip 268. Note that gap 290 is continued between strips 267 and 268, and that strips 267 and 268 are oppositely slanted with respect to the medial plane of symmetry of seal element 250, excluding, of course, asymmetric, raised, serial number 269 and strips 267 and 268 themselves. This opposite slanting once again increases stability over a simpler, in-line configuration.

Figure 21:
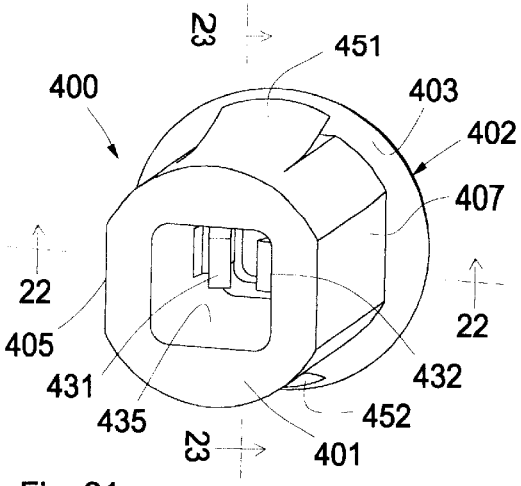
FIG. 21 is a rear perspective view of a second embodiment of the catch element of the present invention, suited to the third embodiment of the seal element shown in FIGS. 14 to 16 and enlarged relative thereto in scale.

FIG. 21 shows second embodiment 400 of the catch elements of the present invention, suitable for lockably engaging rectilinear embodiment 200 of the seal element shown in FIGS. 14 to 16. Generally cylindrical body 401 has opposite, flat sides 405 and 407, and flange 402 has rear surface 403. Body 401 has inside surface 435 from which resilient, internal fingers 431 and 432 extend. After seal 200 has been pushed into plug-catch 400, fingers 431 and 432 snap back in turn behind triangular members 241, 243, and 245, or members 251, 253, and 255 of seal 200, thus lockably engaging 200, in the usual manner. Integrally formed with 400, as by molding, are external, resilient fingers 451 and 452.

Figure 22:
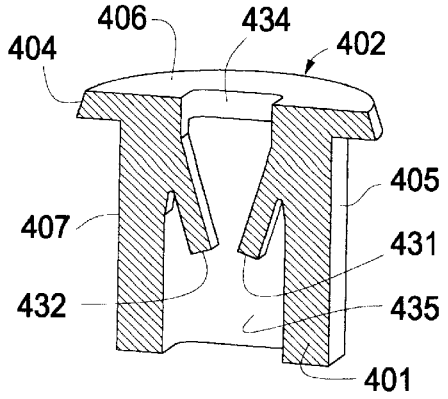
FIG. 22 is a cross-sectional view of the element shown in FIG. 21 taken along lines 22—22.

FIG. 22 shows fingers 431 and 432, and aperture 434 in face 406 of flange 402, through which seal element 200 passes. Flange 402 has angled rim 404.

Figure 23:
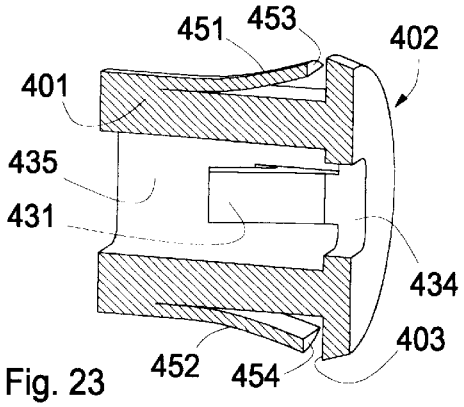
FIG. 23 is a cross-sectional view of the element shown in FIG. 21 taken along lines 23—23.

FIG. 23 shows external, resilient fingers 451 and 452, integrally formed with body 401. Finger 451 ends in flat surface 453 parallel to rear surface 403 of flange 402, and finger 452 ends in flat surface 454 also parallel to surface 403. Surfaces 453 and 454 are equally distant from surface 403.

Figure 24:
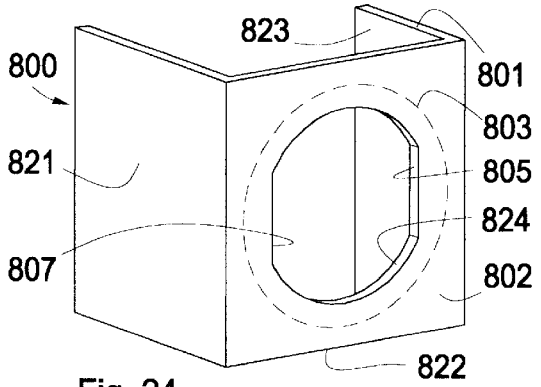
FIG. 24 is an oblique, perspective view of a portion of an arbitrary, thin-walled container.

FIG. 24 shows a portion of generic, thin-walled container 800, having side wall 821, front wall 822 with outer surface 802, and second side wall 823. Side walls 821 and 823 are close together, perhaps ¾", and offer little room for the insertion of a plug catch, much less for turning a nut, such as 310. Container 800 can, however, be easily provided with aperture 824 similar to a cam-lock aperture, being cylindrical except for opposite, flat sides 805 and 807. If plug catch 400 is now inserted into aperture 824, flat sides 805 and 807 will orient 400 so that fingers 451 and 452 come into contact with aperture 824's cylindrical, top and bottom surfaces. As plug-catch 400 is pushed into 824, fingers 451 and 452 will be compressed toward body 401 of catch 400. Fully compressed, fingers 451 and 452 will just pass through aperture 824. Flange 402, however, cannot pass though. Circle 803 indicates the size of surface 403 relative to aperture 824.

Figure 25:
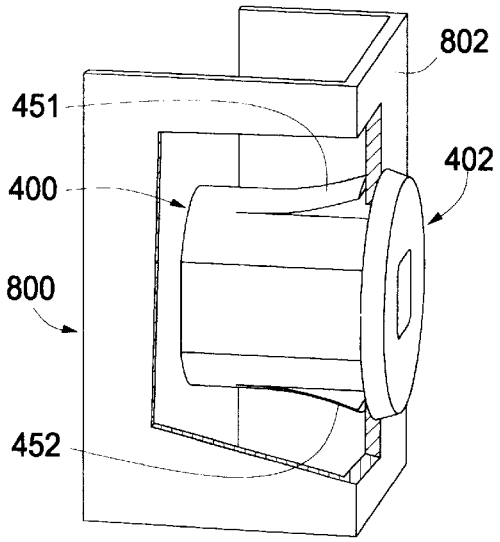
FIG. 25 is a partially, broken away side perspective view of the catch element in FIG. 21 in locking engagement with the thin-walled, container portion shown in FIG. 24.

FIG. 25 shows plug catch 400 just after being pushed into aperture 824 and far as it will go. Resilient fingers 451 and 452 have snapped back up, so that surfaces 453 and 454 now abut the rear of wall 822, and so that flange 402 is held against outer surface 802. Catch 400 is now fixed in place and ready for use.

Figure 26:
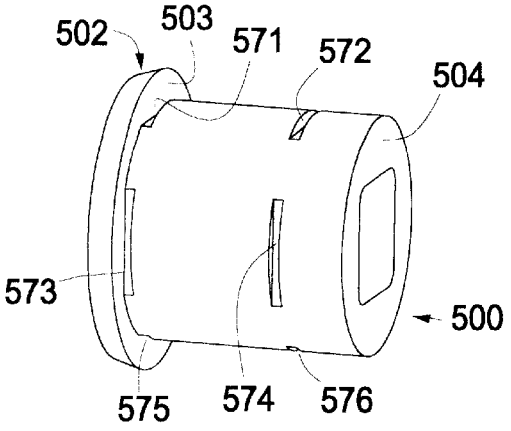
FIG. 26 is a side perspective view of a third embodiment of the catch element of the present invention, suited to the seal element of FIGS. 14 to 16.

FIG. 26 shows third embodiment 500 of the catch elements of the present invention, suited to embodiment 200 of the seal element, and adapted both to especially thin-walled and to especially thick-walled containers. Just behind rear surface 503 of flange 502 are coplanar slots 571, 573, 575, and 577 (see also FIG. 28), and a distance farther down body 504 are coplanar slots 572, 574, 576 and 578 (see also FIG. 28). Each set of four slots contains two, mirror-image pairs, set ninety degrees apart.

Figure 27:
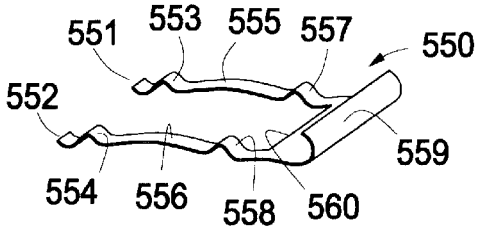
FIG. 27 is a side perspective view of a spring-clip device.

FIG. 27 shows spring-steel clip 550 having legs 551 and 552 and curved, top member 559. Legs 551 and 552 have arched middle segments 555 and 556 and short, humped portions 553 and 557, and 554 and 558, respectively, at either end. Top member 559 has straight, flat edge 560 orthogonal to legs 551 and 552.

Figure 28:
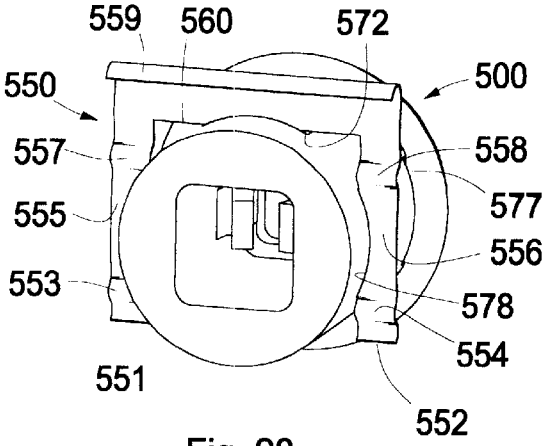
FIG. 28 is a rear perspective view of the elements shown in FIGS. 26 and 27 in clasping engagement with each other.

In FIG. 28 clip 550 is shown in clasping engagement with plug-catch 500. Clip 550 has been pressed down into slots 574 and 578, until being stopped by the contact of edge 560 with the bottom of slot 572, i.e. with body 504. Arched middle sections 555 and 556 remain slightly compressed by slots 574 and 578, respectively. Humped portions 553 and 554, having passed through slots 575 and 578 under somewhat greater compression, have now passed beyond the slots. Their form is somewhat changed due to the remaining compression of arms 551 and 552, however they are not able, unless forced backwards through slots 574 and 578, to pass through the slots unforced, i.e. to slip out. A screwdriver tip placed against curved top portion 559 and jerked upward will quickly remove clip 550.

Rear slots 572, 574, 576, and 578 are useful especially for wood constructions, where wall thicknesses are typically ¾". Font slots 571, 573, 575, and 577 are useful for very thin, sheet-metal constructions.

Figure 29:
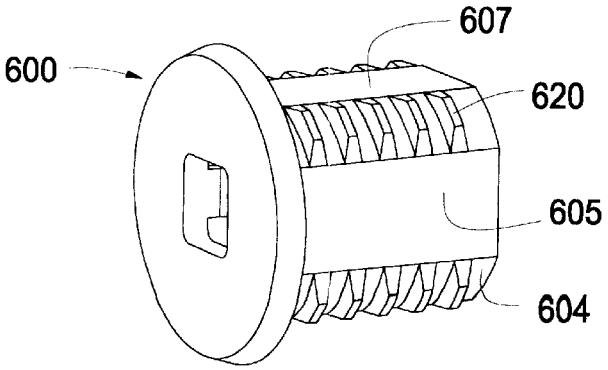
FIG. 29 is a side perspective view of a fourth embodiment of the catch element of the present invention.

FIG. 29 shows a fourth embodiment 600 of the catch elements of the present invention that is similar to catch 300, except that it has four, symmetrically-placed, flat sides, two of which, 605 and 607, are shown. Threads 620, are interrupted by the four flat sides of 60°, yet mate in a continuous manner with nut 310 just as do threads 320 of plug catch 300. Plug-catch 600 can be useful where a cam-lock hole permits the use of a securing nut.

Note that any embodiment of the seal element of the present invention might be used with two different embodiments of the catch elements. Depending on the specific circumstances of an application, seal element 200 might, for example, be used with one, fully-threaded catch, in the manner of plug-catch 300, and with a spring-clip catch, in the manner of plug-catch 500.

Figure 30:
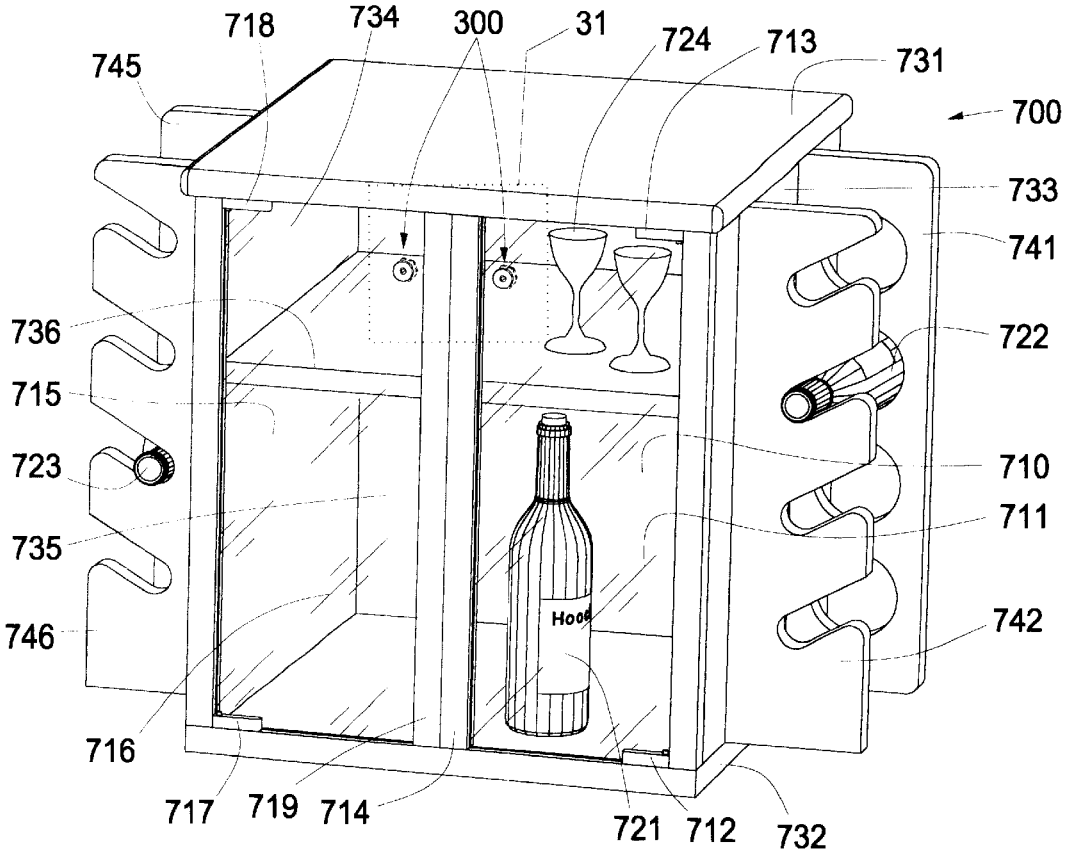
FIG. 30 is a front perspective view of a liquor cabinet to which are attached two catch elements of the present invention.

FIG. 30 shows wooden liquor cabinet 700 having top 731, bottom 732, sides 733 and 734, back 735 and shelf 736. Right rack members 742 and 741 hold bottle 722, and left rack members 745 and 746 hold bottle 723. Cabinet 700 has left glass door 715, comprising glass pane 716, glass hinges 717 and 718, and edge piece 719, and right glass door 710 comprising glass pane 711, glass hinges 712 and 713, and edge piece 714. Bottle 721 is inside cabinet 700 as is a pair of wine glasses 724. Someone, we see, must've been nipping at the sauce, correction, appears to have been enjoying the nice wine in bottle 721, for the cork is partly withdrawn. Perhaps we are in a room at an expensive hotel, or at a private club, of just at home. Plug catches 300 are built into cabinet 700, one in each glass door.

Figure 31:
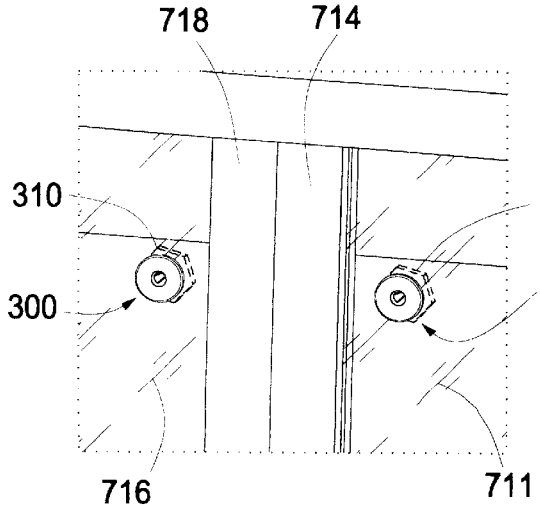
FIG. 31 is a detail of FIG. 30.

FIG. 31 shows plug catches 300 both attached by nuts 310 from behind glass panes 716 and 711. The catches 300 are unobtrusive and can be made in colors matched to various woods or to tinted glass.

Figure 32:
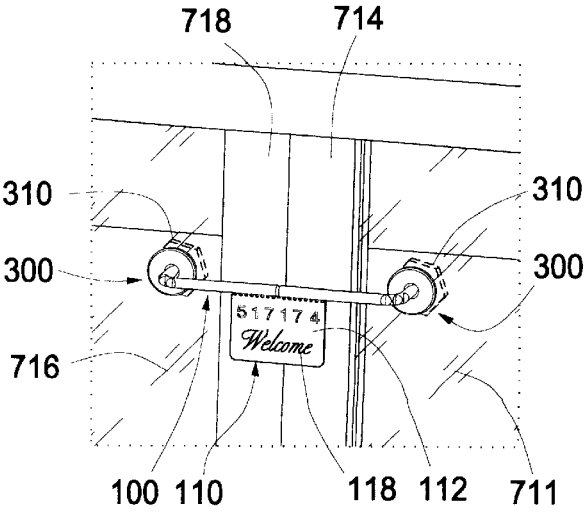
FIG. 32 is the detail of FIG. 30 after the insertion and locking engagement of a first embodiment of the seal element of the present invention with the two catch elements shown in FIG. 30.

FIG. 32 shows seal element 100 lockably engaged in plug catches 300. Tag blank space 112 displays the word "Welcome" in raised letters. Maybe cabinet 700 is in a resort hotel somewhere out in the blue, beautiful Carribean. Ahh. After a guest, the authorized user, removes tag 110, then his/her bill will be charged for whatever bottles he/she opens or takes. The room porter explains to the guest on arrival that he/she may redeem the tag for a discount or a premium of some sort, or perhaps for a free cab ride home from a restaurant, at any time during the guest's stay. The porter records the number of the tag and assigns it to the guest's room in the hotel's computer. If the guest redeems the tag for the premium, there rarely will be a dispute later that he/she did consume or otherwise make use of the beverages.

Inasmuch as modifications and alterations apparent to one skilled in the art may be made in the herein described embodiments of the present invention without departing from the scope and spirit thereof, it is intended that all matter contained herein be interpreted in an illustrative, and not in a limiting, sense with respect to the invention claimed in the following claims and equivalents thereto.

I claim:

1. A tamper-evident seal comprising an engaging element and two catch elements, said engaging element further comprising a first arm, a second arm, an identifying element, and a separation means, said first and second arms being contiguous with said separation means, said first arm being non-contiguous with said second arm, said identifying element being contiguous with said separation means, said first arm and said second arm each having a means adapted for lockably engaging at least one of said catch elements, said first arm being able to pass in its entirety through the catch element to which said first arm is lockably engaged after said identifying element has been separated from said first arm, said second arm being able to pass in its entirety through the catch element to which said second arm is lockably engaged after said identifying element has been separated from said second arm, and in which each said catch element is adapted to be held by mechanical means in an aperture formed in, and extending through, a wall.

2. A tamper-evident seal as in claim 1 in which either said first arm or said second arm is, or said first arm and said second arm are, adapted to be bent at an angle without breaking.

3. A tamper-evident seal as in claim 1 in which said means adapted for lockably engaging at least one of said catch elements terminates in a structure adapted to dislodge from said catch element a remnant of a like-constructed tamper-evident seal that has been broken.

4. A tamper-evident seal as in claim 1 in which said separation means comprises perforation teeth.

5. A tamper-evident seal as in claim 1 in which said separation means comprises a first portion contiguous to said first arm and a second portion contiguous to said second arm, and in which said first and second portions of said separation means are not parallel.

6. A tamper-evident seal as in claim 5 in which said first portion comprises perforation teeth that meet said first arm in an acute angle, and said second portion comprises perforation teeth that meet said second arm in an acute angle.

7. A tamper-evident seal as in claim 5 in which said separation means comprises at least one strip meeting said first arm in at least one acutely angled junction and meeting said second arm in at least one acutely angled junction, and having a width less than the thickness of said identifying element.

8. A tamper-evident seal as in claim 1 in which said separation means comprises at least one strip meeting said first arm in at least one acutely angled junction and meeting said second arm in at least one acutely angled junction, and having a width less than the thickness of said identifying element.

9. A tamper-evident seal as in claim 1 in which at least one of said catch elements has external threading and in which said mechanical means holding said catch element in said aperture is a nut adapted to engage said external threading.

10. A tamper-evident seal as in claim 9 in which said external threading is interrupted.

11. A tamper-evident seal as in claim 1 in which at least one of said catch elements has external threading and in which said mechanical means holding said catch element in said aperture is a deformable substance capable of bonding with said catch element and hardening.

12. A tamper-evident seal as in claim 11 in which said external threading is interrupted.

13. A tamper-evident seal as in claim 1 in which at least one of said catch elements has at least one, external, resilient finger, and in which said mechanical means is said finger.

14. A tamper-evident seal as in claim 1 in which at least one of said catch elements has at least two, external slots, and in which said mechanical means is a clip adapted to be pressed into said slots and to remain in said slots until a forcibly removed.

15. A tamper-evident seal as in claim 1 in which said identifying element has an alphanumeric serial number.

16. A tamper-evident seal as in claim 1 in which said identifying element has a space that may be customized.

17. A tamper-evident seal as in claim 1 in which said identifying element after separation from said engaging element is used for a commercial purpose.

* * * * *